United States Patent [19]

Hartmann

[11] Patent Number: 4,852,944

[45] Date of Patent: Aug. 1, 1989

[54] SEATING FURNITURE, MORE PARTICULARLY CHAIR

[75] Inventor: Theo Hartmann, Tauberbischofsheim-Distelhausen, Fed. Rep. of Germany

[73] Assignee: VS Vereinigte Spezialmöbelfabriken Verwaltungs GmbH, Fed. Rep. of Germany

[21] Appl. No.: 48,764

[22] Filed: May 12, 1987

[30] Foreign Application Priority Data

May 23, 1986 [DE] Fed. Rep. of Germany ..... 3617297

[51] Int. Cl.[4] ..... A47C 5/10

[52] U.S. Cl. ..... 297/445; D6/373; 297/239; 297/419; 297/440

[58] Field of Search ..... 297/239, 419, 440, 443–447; D6/371–376

[56] References Cited

U.S. PATENT DOCUMENTS

| | | | |
|---|---|---|---|
| 1,993,601 | 3/1935 | Goldberg | 297/239 |
| 2,821,245 | 1/1958 | Meneghelli | 297/419 |
| 4,097,089 | 6/1978 | Peterson | 297/445 X |

FOREIGN PATENT DOCUMENTS

| | | | |
|---|---|---|---|
| 6801234 | 10/1968 | Fed. Rep. of Germany . | |
| 2136852 | 2/1973 | Fed. Rep. of Germany | 297/440 |
| 2150043 | 4/1973 | Fed. Rep. of Germany . | |
| 968692 | 12/1950 | France | 297/419 |
| 36384 | 4/1935 | Netherlands | 297/440 |
| 447826 | 5/1936 | United Kingdom | 297/444 |
| 524397 | 8/1940 | United Kingdom | 297/239 |
| 613284 | 11/1948 | United Kingdom | 297/419 |

OTHER PUBLICATIONS

De-Katalog 104 Ocr Mobelfabrik Lubke und Rolf, Rheda S. N 4 (eingegbeim DPA: 15.1.65).

*Primary Examiner*—Peter R. Brown
*Attorney, Agent, or Firm*—Steele, Gould & Fried

[57] ABSTRACT

In a stackable article of seating furniture, supporting frames forming the sides members are defined by two sectional members which are bent at an angle from rod-like sections. Connecting members are attached to arm ends of the sectional members. Each pair of associated connecting members is interconnected at a nodal member by a pin, one of the sectional members forming a front bearing support lying offset inwardly in relation to the sectional member forming the rear bearing support. The resulting articles can be mass produced very simply from modular elements, and have high strength and high dimensional accuracy.

41 Claims, 6 Drawing Sheets

1
5
25
18'
16
10
7
19
21
17
4
3
11
22
2
9
13
14
16
8
20
18
15
12
17
19
6

Fig.9
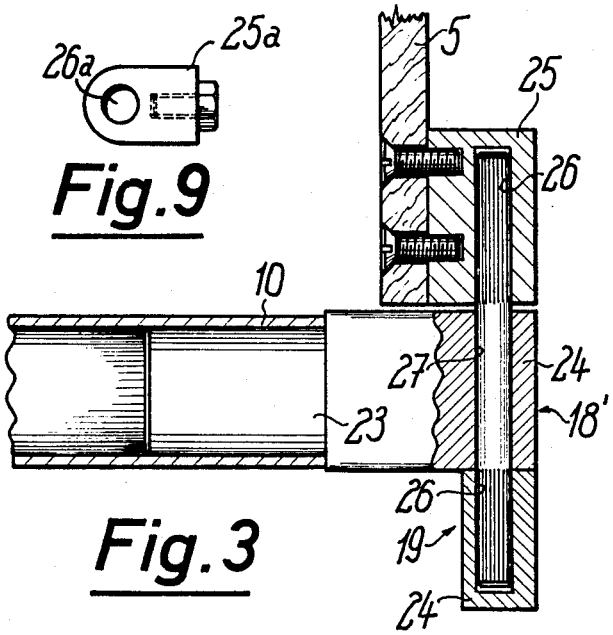
Fig.3
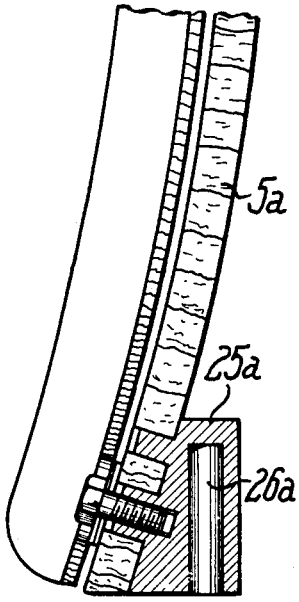
Fig. 4
Fig.5
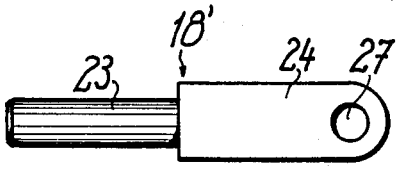
Fig.7
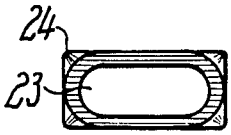
Fig.6
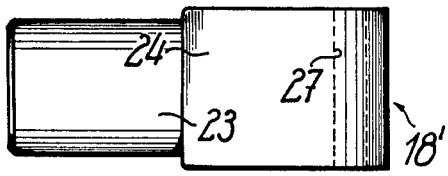
Fig.8
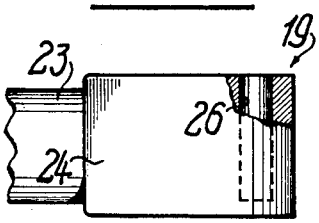

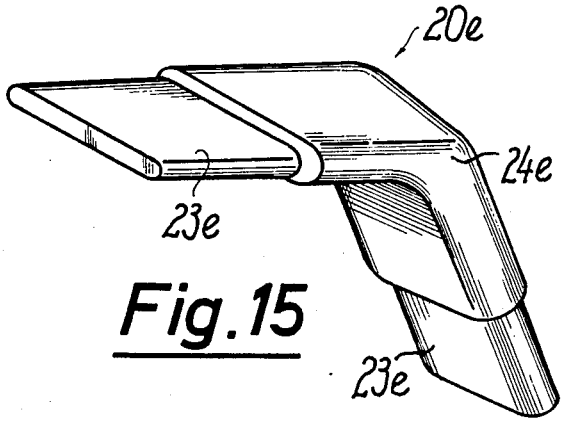
Fig.15
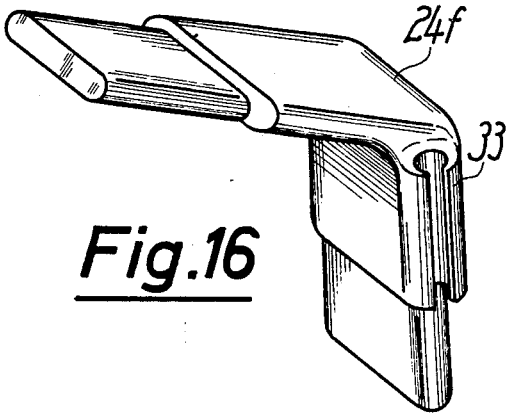
Fig.16
Fig.17
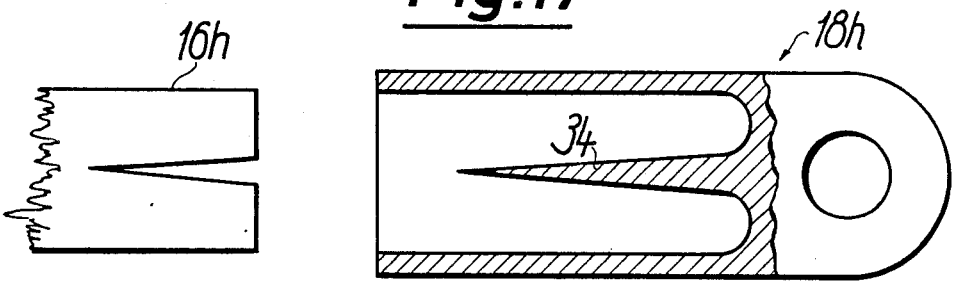

SEATING FURNITURE, MORE PARTICULARLY CHAIR

BACKGROUND OF THE INVENTION

1. Field of the Invention

The invention relates to an article of seating furniture, more particularly a chair, settee or the like, having at least one standing profile supporting frame which is disposed laterally of a sitting member and forming a chair standing surface as well as front and rear bearing supports and has a supporting connection for the sitting member.

2. Prior Art

Numerous types of steel tube, shaped timber and rattan seating furniture are known which are made up from bent sectional rods, which are usually welded, glued or screwed together. The portions of the rod sections which are to be interconnected must be so adapted to one another as to bear against one another over as large an area as possible, and due to the resulting manufacturing tolerances this may lead to difficulties which adversely affect strength and accuracy of dimensions of the finished chair.

SUMMARY OF THE INVENTION

It is an object of the invention to provide an article of seating furniture of the kind specified which is very simple to manufacture and can produce to such accurate dimensions that the profile member ends can be reliably interconnected without special shape adaptation.

To this end, in an article of seating furniture of the kind specified, according to the invention the supporting frame has two separate profile members each of which is bent at least once, the arm ends of their frame arms being attached to connecting members via which the arm ends of the profile members engage in one another positively thereby forming nodal members. Preferably, therefore, the sectional or profile members are interconnected exclusively at their ends, which can be formed merely by straight parting cuts lying at right angles to such ends. Due to the nodal members formed, for example, directly by the connecting members, on the one hand the arm ends and therefore the section members themselves are aligned, while on the other hand the arrangement can also be such that the position of the connecting members can be adapted at least to a limited extent to the position of the arm ends, allowing compensation of many kinds for tolerances. The chair of the like can also be put together on the unit construction principle, identical profile members and if necessary connecting and nodal members also being suitable for making different articles of seating furniture, or even other articles of furniture, such as tables, shelves or the like.

The particular supporting frame can be made up of more than two sectional members; in any case the sectional members are so disposed as to form a frame which is closed all round, beyond whose annular shape or outer periphery advantageously no kinds of supporting frame members project. However, a particularly stable, simple, arrangement which can be readily produced is for the supporting frame to have exclusively two bent sectional members, of which preferably both extend over the whole height of the supporting frame—i.e., each occupy substantially half of the annular shape. One sectional member forms the front bearing support, preferably being bent in the direction of the rear side of the chair or the like at the top end of the bearing support, more particularly by a radius of curvature approximately one half the width of the supporting frame, and extending at least substantially as far as such rear side. Conveniently the other sectional member forms the rear bearing support and is bent in the direction of the front side of the chair or the like at the bottom end of the bearing support over a substantially smaller radius of curvature, the other sectional member advantageously extending as far as the front side of the supporting frame. All the supporting frame sectional members can therefore be interconnected exclusively at two places, such places conveniently lying in the front bottom and rear top zones of the supporting frame and being formed by connecting members or nodal members.

An even more advantageous construction is produced if one or all of the sectional members of the particular supporting frame are bent or deformed exclusively in one plane, so that they can be produced in the form of very simple bent members. To ensure that the article of furniture can nevertheless be stacked, the sectional members of the supporting frame conveniently stand in substantially vertical planes immediately adjacent one another in the width direction of the article of furniture, and the front sectional member can engage in a very simple way in the inside of the rear sectional member of another article of furniture for purposes of stacking, if the rear bearing support is offset outwardly in relation to the front bearing support by at least its width.

The connecting member can very simply engage substantially free from clearance in the associated arm end via a stem portion taking the form more particularly of a plug-in pin, plug-in wedge or the like and have a connection head which adjoins the end surface of such arm end and, viewed in the longitudinal direction of the arm end, projected most slightly beyond the outside contour of the sectional member. Conveniently all the connecting heads of the supporting frame and of the article of furniture have a substantially identical outside contour, so that in practice they can be interchanged as required.

A particularly advantageous further feature of the invention is that the connecting members engage with one another while being pivotable in relation to one another, more particularly around an axis substantially at right angles to the plane of the supporting frame, so that after they have been connected to the sectional mambers and to one another, they can adapt themselves in their position substantially free from stress to the shape of the sectional members, so that tolerance deviations can be compensated self-adjustingly in a very simple manner. To enhance the strength of the finished supporting frame or article of furniture, connecting members interconnected directly to form a nodal member can be secured in relation to one another; this can be done, for example, by a process in which the connecting members are first joined together via a glue-coated pivoting pin engaging bores, and then aligned in relation to one another, whereafter the suitably adjusted glue solidifies and produces a connection which is rigid—i.e., can no longer be pivoted.

To enable the articles of furniture to engage in one another as deeply as possible during stacking, the connecting members of each nodal member also lie one beside the other in the manner described, so that the inner connecting members of one article of furniture can lie during stacking immediately adjacent the outer connecting members of the other article of furniture.

Although it is conceivable to connect the supporting frame directly via one or more cross-members to another supporting frame of the same chair or the like, or of the adjacent chair, for example, when the chairs are arranged in rows, advantageously in the case of chairs or the like which have a plate-shaped structural member lying between such supporting frames, for example, a seat member and/or a back rest in the case of a chair, such structural member forms a cross-members, so that no separate cross-member is required in its zone. In a preferred embodiment of a chair, in the rear top zone of the supporting frame the back rest forms a cross-member, and preferably attached to the associated outside or rear side of such structural member is a connecting head which is of substantially the same size as the other connecting heads and extends over only a small part of the width of such structural member and in which the associated pin connecting the sectional members engages, so that three connecting heads lying adjacent one another in the longitudinal direction of the pin and the pivoting axis forming nodal member in which the central connecting head belongs to one of the sectional members, more particularly the sectional member forming the front bearing support.

In another embodiment, in which the connecting members of the nodal member must have their position or angular position predetermined in relation to one another, every time at least two connecting members of a nodal member are constructed such that they are unitary with one another; in the case of three or more connecting heads forming a nodal member, all the connecting heads can form a single structural component. With both a plug-in or pivotal connection and also with a unitary construction of the connecting heads, at least two connecting heads of a nodal member can also advantageously be so constructed that both associated arm ends and frame arms and sectional members lie in a common plane. In that case as a rule the articles of furniture cannot be stacked, unless the sectional members are deformed not only in the plane of the supporting frame but also at right angles thereto, for example, are so provided with portions bent at right angles and lying adjacent their arm ends that the part of the sectional member lying between the arm ends stands in an outwardly or inwardly offset plane.

The construction according to the invention is more particularly suitable for articles of seating furniture whose sectional members have flatly oval cross-sections such that the major edge dimension of such cross-section lies in the width direction of the article of furniture. Due to the construction according to the invention, a tube section, a plywood section of some other similar section can be used for one or at least two sectional members, while it is also possible to make up a single supporting frame from two or more sectional members of different materials, the sectional member forming the front bearing support, for example, being made of wood while the sectional member forming the rear bearing support is made of steel. By suitable lacquering or surface treatment the sectional member can be given a highly variable contrasting visual appearance, making the article or group of furniture look very attractive. Special steel is another material which can be used.

These and other features of preferred further embodiments of the invention can also be gathered from the description and drawings; each of the individual features can be put into effect on its own or grouped in subcombinations in an embodiment of the invention and in other fields.

BRIEF DESCRIPTION OF THE DRAWINGS

Embodiments of the invention will now be described in greater detail with reference to the drawings, wherein:

FIG. 3 is a section, taking along the line III—III in FIG. 2, shown rotated through 90°, FIG. 4 is detail of a variant embodiment of a back rest, shown in a manner corresponding to FIG. 3, FIG. 5 is a side elevation of the central connecting member shown in FIG. 3, FIG. 6 is a plan view of the connecting member shown in FIG. 5, FIG. 7 is a view of the stem end of the connecting member shown in FIG. 5, FIG. 8 shows the outer connecting member (FIG. 3) in a manner corresponding to FIG. 6, FIG. 9 is a side elevation of the connecting head associated with the back rest (FIG. 3), turned through 180°, FIG. 15 shows in perspective another embodiment of a nodal member, FIG. 16 shows another embodiment of a nodal member in a manner corresponding to FIG. 15, and FIG. 17 is a cross-section through another embodiment of a connecting member.

DETAILED DESCRIPTION OF THE PREFERRED EMBODIMENTS

Figure 1:
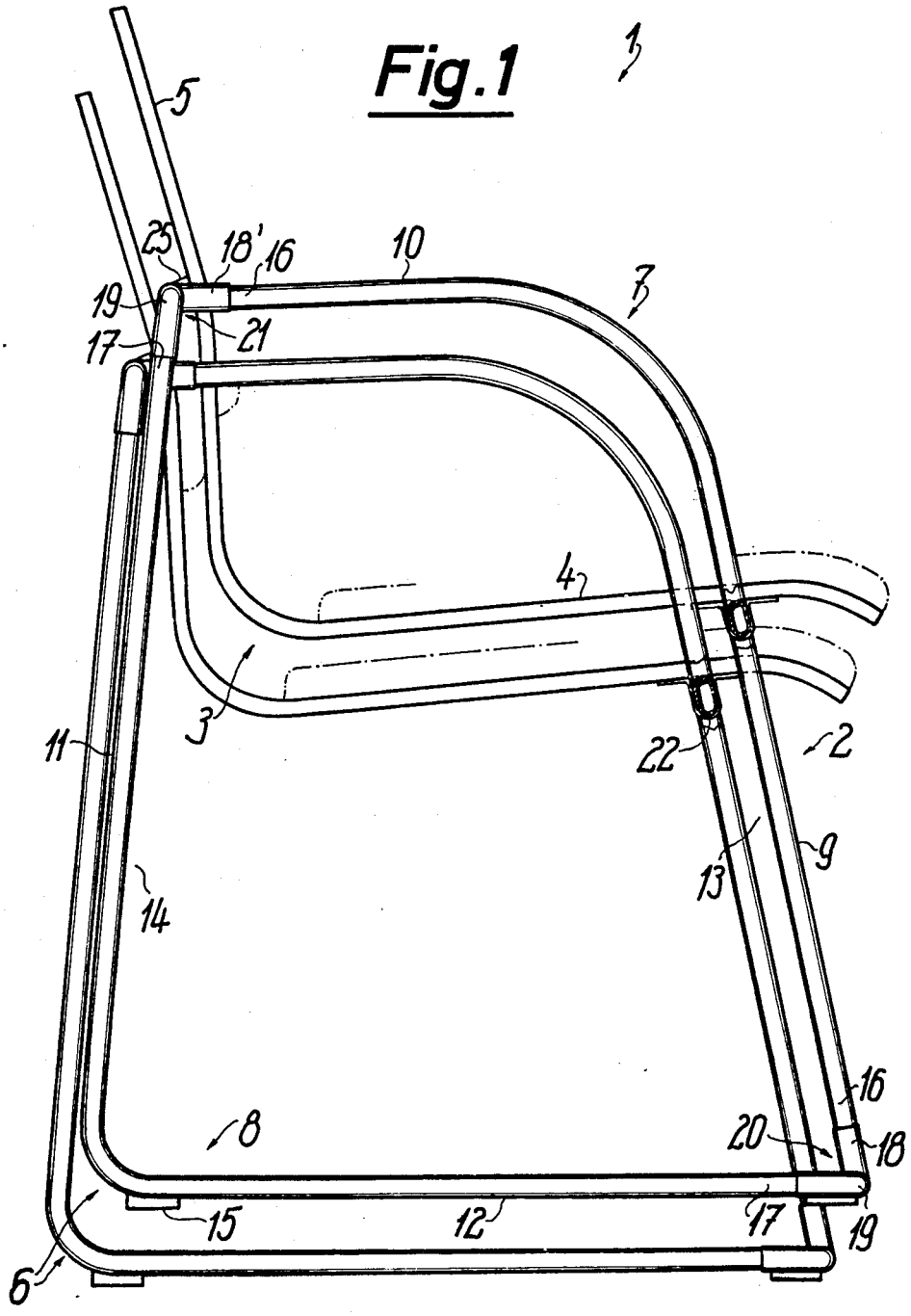
FIG. 1 shows two articles according to the invention in side elevation and stacked condition.
Figure 2:
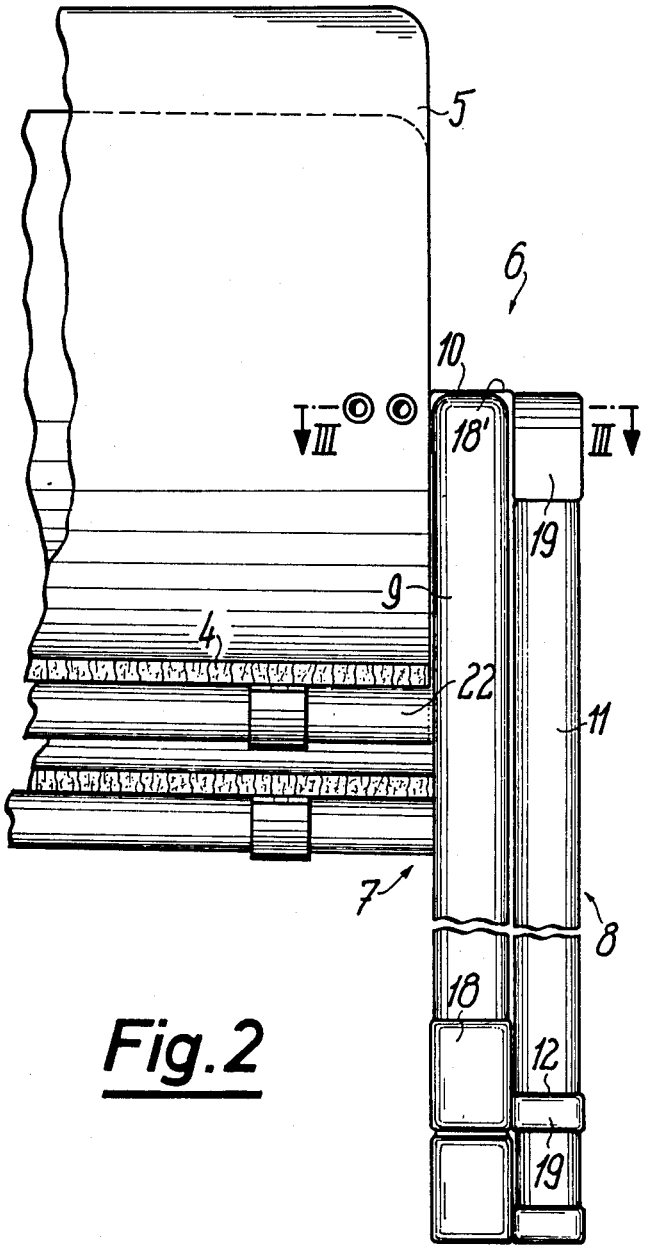
FIG. 2 is a partially sectioned front elevation of detail of FIG. 1.

Referring to FIGS. 1 to 9, an article of seating furniture 1 according to the invention has a frame-shaped supporting frame 2 bearing a, for example, wooden furniture body in the form of a substantially angular seat body 3 which co-operates with one arm to form a seat member 4 and with the other arm to form a back rest 5. The supporting frame 2 comprises mainly two side members in the form of sectional supporting frames 6, which are closed substantially in a ring, stand laterally of the furniture body and can be interconnected, for example, at least partially via the furniture body or separate transverse or supporting connections to form a structural unit inherently substantially rigid in shape.

Each supporting frame 6 has exclusively two rod-shaped sectional members 7, 8, each of which stands continuously in a single substantially vertical plane or is merely simply bent, and has frame arms 9 to 12 of different lengths of a tube section having flatly oval cross-sections. Each of the two sectional members 7,8 co-operates with an upright frame arm 9, 11, respectively, to form a rectilinear bearing support 13,14 extending substantially over the whole height of the supporting frame 2, while the top frame arm 10 of one sectional member 7 forms an arm rest and the bottom frame arm 12 of the other sectional member 8, substantially parallel therewith, forms the standing surface 15 of the chair 1 or the like. Conveniently the two sectional members 7, 8 are made from different sections of the same cross-section, namely by way of example flatly oval basic cross-section, although preferably the minor dimension of the cross-section lying transversely of the width direction of the article of furniture is identical in both sections, while the major edge dimension of the cross-section lying in the width direction of the seat so differs that conveniently the sectional member 7 forming the front bearing support 13 and offset in relation to the other sectional member 8 has the larger cross-section. As shown more particularly in FIG. 2, the sectional member 7 so stands in a parallel plane immediately adjacent the associated sectional member 8 that the plane of the inside of the sectional member 8, facing the center of the width of the furniture body, lies at only a small distance from the plane of the facing outside of the sectional member 7, the two sectional members 7, 8 viewed in side elevation (FIG. 1), having no crossing places or zones of registration. In side elevation the supporting frame 6 is substantially trapezoidal, so that the front bearing support 13 is inclined rearwardly at an acute angle and the rear bearing support 14 is inclined forwardly at a substantially equal acute angle, although the radius of curvature of the transition of the frame arms 11, 12 of the sectional member 8 is substantially smaller than the radius of curvature of the corresponding transitional portion between the frame arms 9, 10. The bottom frame arms 12 of the sectional members 8 extend substantially over the whole depth of the furniture or seat body 3. If the chair 1 or the like is constructed to be arranged in rows, it is also conceivable for the particular individual article of furniture to have only one single lateral supporting frame 6 and for it to obtain its standing stability only via the opposite connection to the matching supporting frame of an adjacent article of furniture. Attached to both arm ends 16,17 respectively, of both frame arms 9, 10, and 11,12 of each sectional member 7,8 is a connecting member 18,19 of metal such as steel, plastics, timber or the like, which is so connected, substantially directly or varying directly against or in transition to the associated connecting member of the frame arm of the other sectional member, that the two sectional members 7, 8 form each supporting frame 6 which is substantially resistant to bending in itself and to deformations in its plane, that can have at most a slight resilient deformability. At least each two interconnected members 18, 19 form a nodal member 20, 21, each supporting frame 6 having exclusively two nodal members 20,21. One nodal member lies in the front bottom zone of the supporting frame 6, while the nodal member 21 is provided in the top and substantially hindmost zone of the supporting frame 6. As a result, when viewed in side elevation (FIG. 1), the nodal member 20, 21 lie substantially completely outside the inside of the seat body 3—i.e., below the top side of the seat member 4 and behind the front side of the back rest 5. In the embodiment illustrated the supporting connection between the two lateral supporting frames 6 is formed on the one hand by a cross-member 22 connecting the two front bearing supports 13 and on the other hand by the back rest 5 and therefore the furniture body itself. The cross-member 22 is formed by a rectilinear, flatly oval tube section of upright cross-section, which is so attached to the facing inside of the bearing supports 13 immediately below the seat member 4 by welding or the like that in side elevation it is completely covered by the bearing support 13. At least one clamp or the like engaging below the cross-member 22 is attached to the underside of the seat member 4, so that this is rigidly connected to the supporting frame 2.

As shown more particularly in FIGS. 3 to 9, each connecting member 18, 18', 19 has a stem portion 23 whose external cross-section is closely adapted to the internal cross-section of the associated sectional member or arm end and is inserted therein and if necessary secured by pressing, gluing or the like. The stem portion 23 is adjoined via a shoulder surface bearing over its whole surface against the end surface of the associated arm end 16,17 by a connecting head 24 which also has for its length external cross-sections which are substantially constant and project only slightly outwards in relation to the associated arm end, and is rounded off at the end, viewed in side elevation (FIG. 1), in the shape of a semicircle, the stem portion 23 having substantially the same length as the connecting head 24. The outermost and innermost connecting head 24, 25, viewed in side elevation (FIG. 2) has a blind bore 26 lying at right angles to the plane of the supporting frame 6, while a connecting head 24 possibly lying between two connecting heads 24, 25 has a continuous bore 27 in alignment therewith. All the connecting heads 24, 25 of the particular nodal member 20,21 are interconnected via a single cylindrical pin 28 having substantially continuously constant cross-section over its length, the pin engaging in the aligned bores and being completely covered at its ends by the particular innermost and outermost connecting head 24, 25. In the case of the nodal member 20, both connecting members 18, 19 have facing, aligned bores, while in the case of the nodal member 21 the connecting member 18' of the sectional member 7 lies between two connecting heads 24,25, of which the connecting head 21 is constructed without a stem portion and is attached directly to the rear side of the back rest 5 via through bolts or the like. During assembly the connecting members already attached to the sectional members 7,8 and also the two connecting heads 25 attached to the back rest 5 are put together in the particular nodal member 20,21 by the use of a pin 28; the pin 28 and the bore walls can be previously coated with a suitable glue. Before the glue solidifies, the sectional members 7, 8 thus interconnected are aligned in the required in relation to one another and retained in the aligned condition, until the glue has set and therefore the nodal member has solidified rigid. Conveniently the cross-member 22 is attached to the two associated members 7,8 before they are thus connected, but it can also be applied to the two lateral supporting frames 6 only after they have been completed. The seat member 4 projects forwardly beyond the cross-member 22.

As FIG. 1 shows, the connecting head of the connecting member 19 of the nodal member 20 can be constructed unitarily with the standing block, which forms the standing surface 15 of the chair 1 or the like in the front zone. A corresponding downwardly projecting standing block is also provided in the rear zone of the frame arm 12.

As FIGS. 4 and 9 also show, the connecting head 25*a* can be adapted to the particular shape of the back rest 5*a*. In the embodiment illustrated the back rest is curved in horizontal section so that the connecting head 25*a* has a correspondingly inclined or curved bearing surface for bearing against the rear side of the back rest 5*a* and can have on such bearing surface projecting cams, pins or the like, which engage in matching bores or apertures in the back rest 5*a* to secure position. The attaching screws for the connecting head 25*a* extend through a plate-shaped cushion carrier, disposed on the front side of the back rest 5*a* at a small distance, in the zone of continuous bores,, so that the cushion carrier can be removed independently of the connecting heads 25*a*.

Figure 10:
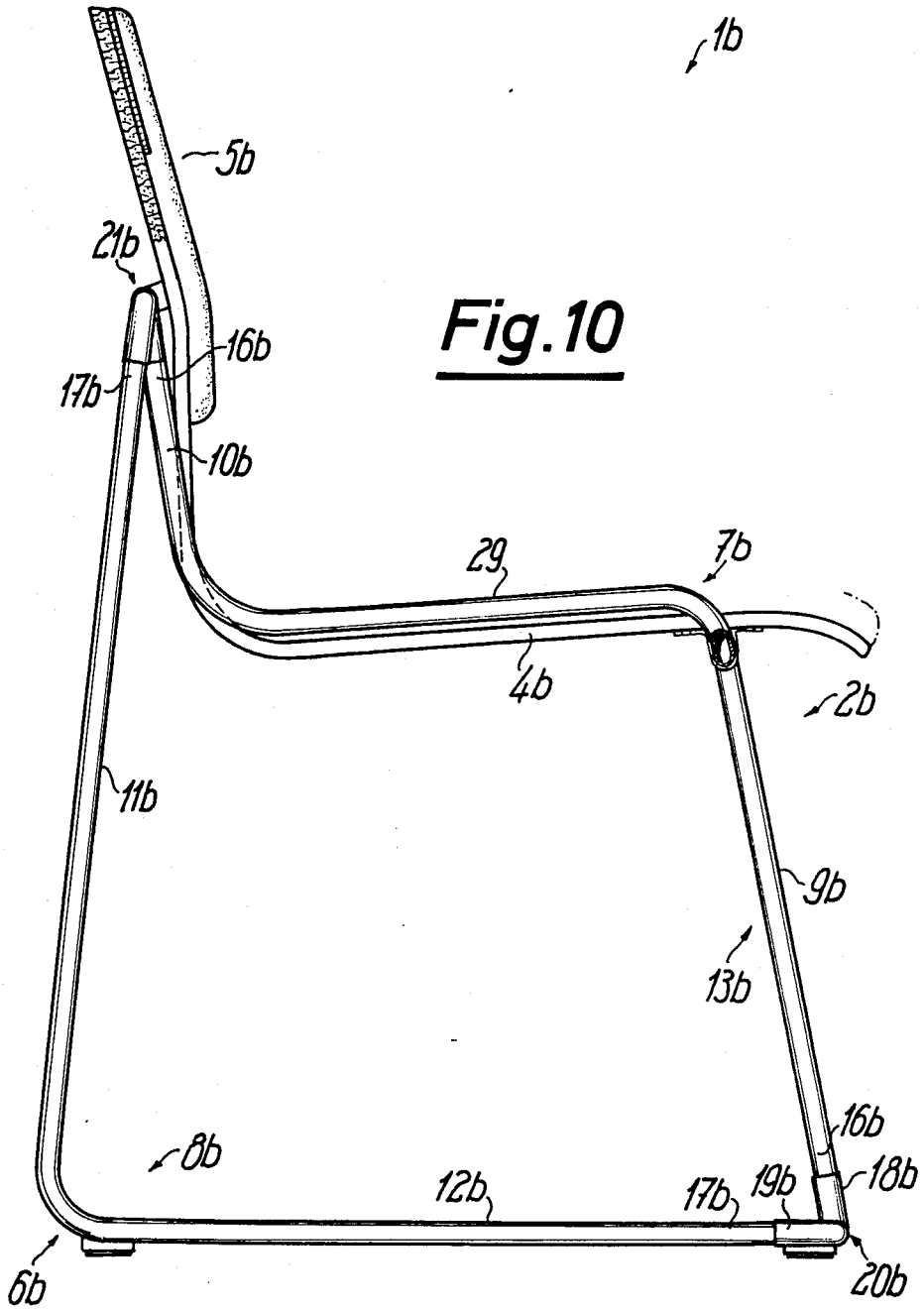
FIG. 10 is a side elevation of another embodiment of a chair or the like, FIG. 11 shows in vertical section another embodiment of a supporting frame, the connecting members being omitted.

In the chair or the like 1b shown in FIG. 10 the sectional member 7*b* of the particular supporting frame 6*b* is bent twice in opposite directions, so that provided between the frame arms 9*b*, 10*b* is an intermediate frame 29 which lies at an angle to the frame arms 9*b*, 10*b* and lies, viewed in side elevation, falling away backwards substantially parallel with the seat member 4*b* and at a small distance above the seat member 4*b*, thus forming a side cheek therefor. In the rear zone the intermediate frame 29 turns upwardly with substantially the same curvature as the transitional portion between the seat member 4*b* and the back rest 5*b*, into the frame of 10*b* which is upwardly directed and rearwardly inclined at a small acute angle and which, viewed in side elevation, lies at an acute, downwardly opening angle to the associated frame arm 11*b* of the sectional member 8*b*. In the embodiment illustrated in FIG. 10 the connecting members can be identical to those in the embodiment illustrated in FIGS. 1 to 9. For the rest, FIG. 10 like references are used to those in FIG. 1, but with the addition of the index "b".

Figure 12:
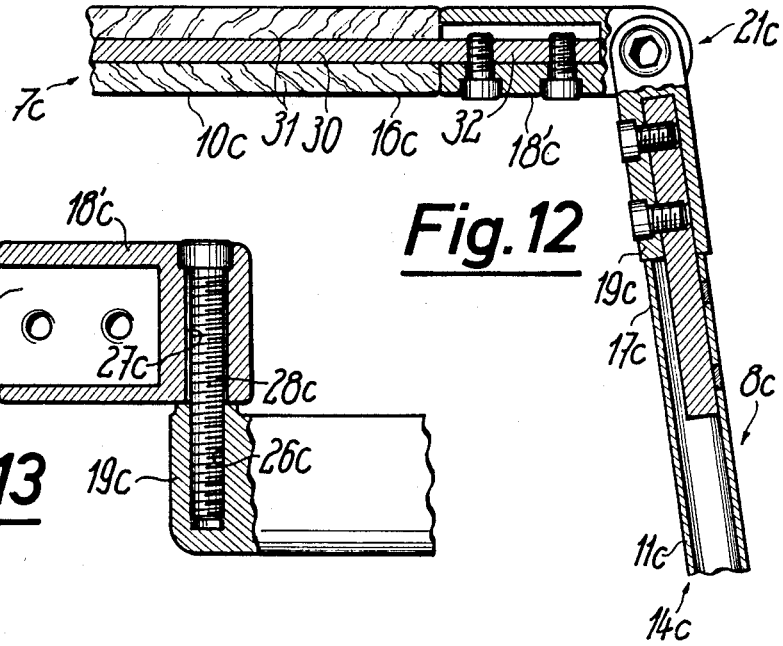
FIG. 12 shows a nodal member of the supporting frame (FIG. 11), sectioned parallel with the plane of the supporting frame.
Figure 13:
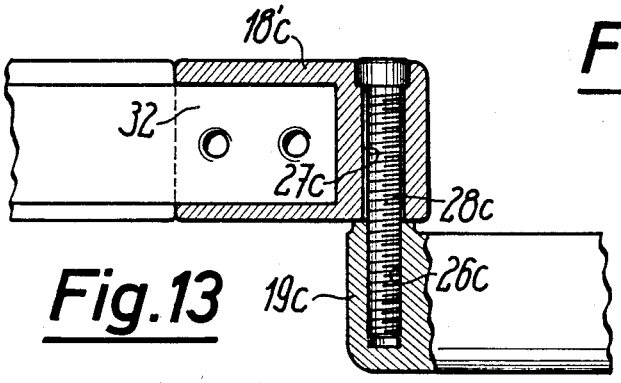
FIG. 13 is a cross-section through the nodal member shown in FIG. 12.
Figure 11:
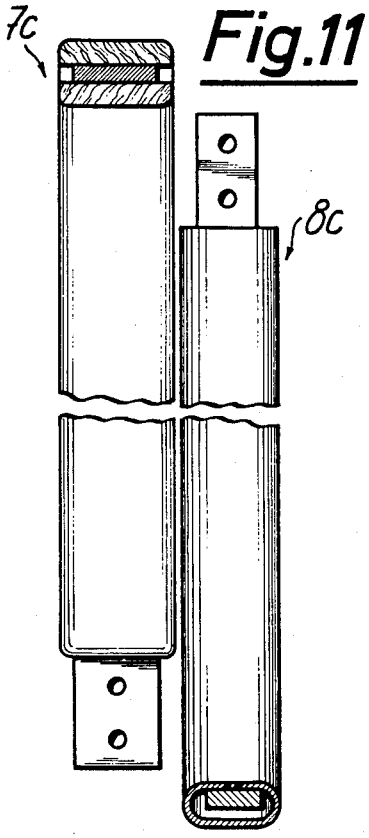

Instead of being made of steel, for example, special steel, the supporting frame and sectional member can also be made at least partially of some other, for example, non-metallic material, such as timber wood or the like, and in the latter case the section is conveniently a plywood section of two or more, more particularly three layers having substantially continuously constant cross-sections over their length. In FIGS. 11 and 12 these layers have the references 30 and 31, one, for example, the central layer being thinner and/or narrower than the two outer layers 31 in construction and so glued thereto that on both sides there are formed laterally of the section grooves whose bottom areas are limited by the side edges of the central layer 30. At the particular arm end 16*c*, at least one, or the central layer 30 is extended beyond two other layers 31, so that a freely projecting attaching plate 32 is formed, which is introduced into a receiving aperture,.completely closed at the outer periphery and adapted to the plate 32 in cross-section, of the associated connecting member 18'*c* and so attached by screws, gluing or the like that the connecting member 18'*c* bears flush against the end surfaces of the other layers 31. Provided as a bolt 28*c* is a screw which extends through a continuous bore 27*c* in the connecting member 18*c* and so engages in a screwthreaded bore 26*c* in the connecting member 19*c* that the head of the screw bolt lies countersunk on the inside of the connecting member 18'*c*. In the embodiment illustrated the sectional member 7*c* is a plywood section, while the sectional member 8*c* is a steel tube section to whose arm end 17*c* a suitable projecting attaching plate is attached by welding or the like, so that the connecting member 19*c* can be attached in a similar manner to the frame arm 11*c*. In this embodiment the sectional member 7*c*, 8*c* can at any time be readily released from one another, and in their nodal members they are permanently interconnected with a slight pivotability. For the rest, in FIGS. 11 to 13 like elements have like references to those in FIGS. 1 to 9, but followed by the index "c".

Figure 14:
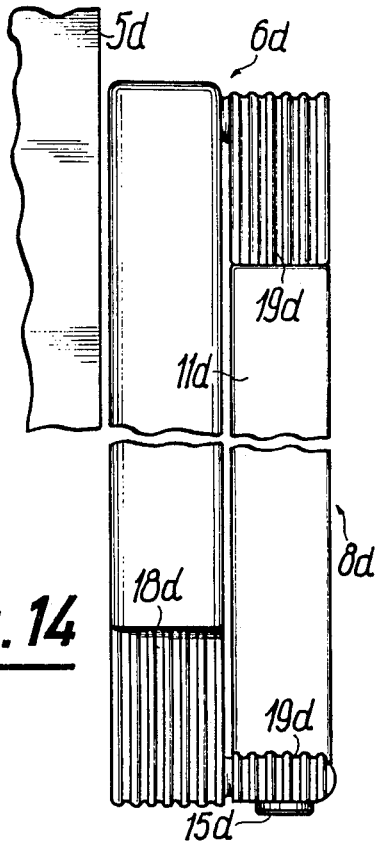
FIG. 14 is a front elevation of another embodiment of a supporting frame.

As shown in FIG. 14, individual connecting members or connecting heads have been profiled on their exposed outer surface by ribbing or the like, so that when the chairs are stacked suchg members form only relatively small, for example, linear contact surfaces and provide a relatively high degree grip to support the chair. Otherwise, in FIG. 14 like elements have like references to those in the other FIGS., but followed by the index "d".

While in the aforedescribed embodiments each nodal member is formed by two or three separate connecting members or connecting heads, the nodal member shown in FIG. 15 can also be constructed, for example, unitarily by both associated sectional members standing in a common plane. The nodal member 20*e* (FIG. 15) has two unitarily connected stem portions 23*e* lying at an angle to one another for engagement in the arm ends of the sectional members, and such stem portions 23*e* are interconnected via a one-piece angular head portion 24*e* which lies exposed. If the nodal member is associated with the back rest, the head portion 24*e* can also be constructed unitary with a laterally projecting connecting head for the attachment of the back rest.

The nodal members according to the invention are also suitable for connecting adjacent articles of furniture or chairs arranged in rows as, for example, in the case of a row of chairs. Referring to FIG. 16, such row-connecting members 33 are provided on the outside of the associated connecting heads 24*f* and are constructed unitarily therewith. The connecting members 33 can take the form of identical members which can be plugged or hooked into one another, or be complementary members or connecting members which can be interconnected via a separate, for example, plug-in coupling member. In any case such row-connecting members can be associated with the bottom nodal members, the top nodal members, or all the nodal members.

FIG. 17 shows another embodiment of a connecting member 18*h* which is more particularly suitable for sectional members of plywood or the like. Inside its receiving aperture for the associated arm end 16*h* the connecting member 18*h* has a splitting wedge 34 which is directed towards the arm end 16*h* and, when the arm end 16*h* is inserted, penetrates into its end surface, thereby opening up the arm end 16*h* and so clamping it in the receiving aperture of the connecting member 18*h* that an extremely secure connection is obtained in which the connecting member 18*h* engages like a socket round the external periphery of the arm end 16*h*. The splitting wedge 34 and its tip is withdrawn in relation to the associated end of the connecting member, so that the wedge penetrates into the arm end only when such end is already gripped in the receiving aperture.

I claim:

1. An article of seating furniture, comprising:

at least one circumferentially closed profile supporting frame (6) disposed laterally of a sitting member (4) and having at least one lower standing surface (15) located in a standing plane for the article, said supporting frame being assembled from two separate angled members (7, 8) made of elongated profile sections, each of said angled members (7, 8) being bent at least once substantially only in a single plane substantially parallel to a plane of the supporting frame, thereby forming an angle, front and rear supporting legs (13, 14) and a supporting connection for the sitting member (4) being provided on said supporting frame (6), each of said angled members (7, 8) forming one of the supporting legs (13, 14) and defining frame arms (9, 10 and 11, 12) having arm ends (16, 17) with an outer contour;

connecting members (18, 19) affixed to said arm ends (16, 17), the arm ends (16, 17) of the angled members (7, 8) engaging one another positively via said connecting members (18, 19); and, wherein said arm ends (16, 17) of the angled members (7,8) adjoin one another at an angle, said connecting members (18, 19) being formed by separable nodal members (20, 21), each of the nodal members having plug-in attachment members (23) providing means for receiving associated ones of said arm ends (16, 17) to be connected and connecting heads (24) projecting beyond the connected arm end (16, 17), each said connecting head (24) having an outer contour substantially equal to an outer contour of the connected arm end (16, 17).

2. The article of seating furniture according to claim 1, wherein the supporting frame (6) has only two bent angled members (7, 8).

3. The article of seating furniture according to claim 2, wherein the associated attachment members of a nodal member are separate parts interconnected to one another .

4. The article of seating furniture according to claim 1, wherein one angled member (7) forming a front supporting leg (13) is bent at a top end in a direction to a rear side of the seating furniture (1).

5. The article of seating furniture according to claim 1, wherein one angled member (8) forming a rear supporting leg (14) is bent at a bottom end in a direction to a front side of the seating furniture (1).

6. The article of seating furniture according to claim 1, wherein the two angled members (7, 8) are interconnected via nodal members (20, 21) exclusively in a front bottom and a rear top zone of the supporting frame (6).

7. The article of seating furniture according to claim 1, wherein at least one angled member (7, 8) has only one single angled bend.

8. The article of seating furniture according to claim 7, wherein said angled member (7, 8) forms rectilinear frame arms (11, 12).

9. The article of seating furniture according to claim 1, wherein one single angled member forms the rear supporting leg, the one single angled member having only one single angled bend.

10. The article of seating according to claim 9, wherein the angled bend is an acute-angled bend.

11. The article of seating furniture according to claim 1, wherein at least one angled member (7*b*) has two angled bends.

12. The article of seating furniture according to claim 11, wherein the angled bends of said at least one angled member are opposed bends.

13. The article of seating furniture according to claim 11, wherein said at least one angled member (7*b*) forms two rectilinear frame arms (9*b* 10*b*).

14. The article of seating furniture according to claim 13, wherein the frame arms (9*b* 10*b*) are substantially parallel with one another.

15. The article of seating furniture according to claim 11, wherein between the angled bends said at least one angled member (7*b*) has a rectilinear intermediate frame section (29).

16. The article of seating furniture according to claim 1, wherein the angled member (7*b*) forming the front supporting leg (13*b*) has two angled bends.

17. The article of seating furniture according to claim 16, wherein the angled bends are obtuse-angled bends of the angled member forming the front supporting leg.

18. The article of seating furniture according to claim 1, wherein said at least one supporting frame has at least one substantially horizontal frame arm (12, 12*b*) extending substantially over an overall depth of the sitting member (4, 4*b*).

19. The article of seating furniture according to claim 1, wherein said at least one supporting frame (6) has a substantially horizontal frame arm (10) provided as an arm rest above the sitting member (4).

20. The article of seating furniture according to claim 1, characterized in that at least two arm ends (16, 17) of said frame arms (9, 12 and 10, 11) of separate angled members (7, 8) adjoin one another at an angle near 90°.

21. The article of seating furniture according to claim 1, wherein two arm ends (16*b*, 17*b*) of frame arms (10*b*, 11*b*) of separate angled members (7*b*, 8*b*) adjoin one another differing at most by a few degrees with respect to a parallel arrangement of said two arm ends.

22. The article of seating furniture according to claim 21, wherein said arm ends (16, 17*b*) adjoin one another in rear top zone of the supporting frame (6*b*).

23. The article of seating furniture according to claim 1, wherein the angled members (7, 8) of the supporting frame (6) stand in substantially vertical planes located directly adjacent to one another in a lateral direction of the seating furniture.

24. The article of seating furniture according to claim 1, wherein the rear supporting leg (14) of the supporting frame is offset laterally outwardly with respect to the front supporting leg (13) at least by a width of its cross-section.

25. The article of seating furniture according to claim 1, wherein the connecting members (18, 19; 18*h*) engage in the associated arm ends (16, 17) by means of shaft portions (23) forming plug-in wedge members (34).

26. A seating furniture according to claim 1, wherein adjacent connecting heads are constructed to be secured to one another to form an inherently rigid nodal member (27; 21).

27. A seating furniture according to claim 1, wherein connecting members are constructed in one piece with one another to form a unitary nodal member (20*e*).

28. The article of seating furniture according to claim 1, wherein the sitting member (4) forms a cross-member of said at least one supporting frame (6).

29. The article of seating furniture according to claim 28, wherein a back rest (5) adjoins the sitting member (4) in one piece therewith, a connecting head (25) for said back rest (5) being attached to a rear side of the back rest, a pin (28) connecting the connecting head (24) of one of the nodal members to the connecting head (25) for the back rest (5).

30. The article of seating furniture according to claim 1, wherein at least one angled member (7, 8) has a maximum cross-sectional dimension in the width direction of the seating furniture.

31. The article of seating furniture according to claim 1, wherein at least one angled member (7, 8) has a substantially flatly oval cross-section.

32. The article of seating furniture according to claim 1, wherein at least one angled member (7, 8) is formed by a tube section.

33. The article of seating furniture according to claim 1, wherein at least one angled member (*7c*) is formed by a plywood section adapted for receiving said associated attachment member.

34. The article of seating furniture according to claim 1, wherein two lateral supporting frames structure (6) are interconnected by means of at least one cross-member (22) to form a supporting frame (2).

35. The article of seating furniture according to claim 39, wherein two identical angled members (7) of the two supporting frames (6) forming the front supporting legs (13) are rigidly interconnected by means of a separate cross-member lying as a bearing below the sitting member (4).

36. The article of seating furniture according to claim 1, wherein the seating furniture is forming a chair.

37. The article of seating furniture according to claim 1, wherein the seating furniture is a settee.

38. The article of seating furniture according to claim 1, wherein a substantially intermediate frame section (29) of an angled member of said at least one supporting frame (6) is provided as defining a side member for said sitting member (**4*b*) substantially adjacent a level of the sitting member (4*b*), said intermediate frame section (29) being located between frame arms (9*b* 10*b***) of said angled member.

39. An article of seating furniture, comprising:

at least one circumferentially closed profile supporting frame (6) disposed laterally of a sitting member (4) and having at least one lower standing surface (15) located in a standing plane for the article, said supporting frame being assembled from two separate angled members (7, 8) made of elongated profile sections, each of said angled members (7, 8) being bent at least once substantially only in a single plane substantially parallel to a plane of the supporting frame, thereby forming an angle, front and rear supporting legs (13, 14) and a supporting connection for the sitting member (4) being provided on said supporting frame (6), each of said angled members (7, 8) forming one of the supporting legs (13, 14) and defining frame arms (9, 10 and 11, 12) having arm ends (16, 17) with an outer contour;

connecting members (18, 19) affixed to said arm ends (16, 17), the arm ends (16, 17) of the angled members (7, 8) engaging one another positively via said connecting members (18, 19); and, wherein said arm ends (16, 17) of the angled members (7,8) adjoin one another at an angle, said connecting members (18, 19) being formed by separable nodal members (20, 21), each of the nodal members having plug-in attachment members (23) providing means for receiving associated ones of said arm ends (16, 17) to be connected and connecting heads (24) projecting beyond the connected arm end (16, 17), each said connecting head (24) having an outer contour substantially equal to an outer contour of the connected arm end (16, 17), connected connecting heads (18', 19) engaging each other pivotably around an axis lying in a width direction of the seating furniture.

40. An article of seating furniture, comprising:

at least one circumferentially closed profile supporting frame (6) disposed laterally of a sitting member (4) and having at least one lower standing surface (15) located in a standing plane for the article, said supporting frame being assembled from two separate angled members (7, 8) made of elongated profile sections, each of said angled members (7, 8) being bent at least once substantially only in a single plane substantially parallel to a plane of the supporting frame, thereby forming an angle, front and rear supporting legs (13, 14) and a supporting connection for the sitting member (4) being provided on said supporting frame (6), each of said angled members (7, 8) forming one of the supporting legs (13, 14) and defining frame arms (9, 10 and 11, 12) having arm ends (16, 17) with an outer contour;

connecting members (18, 19) affixed to said arm ends (16, 17), the arm ends (16, 17) of the angled members (7, 8) engaging one another positively via said connecting members (18, 19); and, wherein said arm ends (16, 17) of the angled members (7, 8) adjoin one another at an angle, said connecting members (18, 19) being formed by separable nodal members (20, 21), each of the nodal members having plug-in attachment members (23) providing means for receiving associated ones of said arm ends (16, 17) to be connected and connecting heads (24) projecting beyond the connected arm end (16, 17) each said connecting head (24) having an outer contour substantially equal to an outer contour of the connected arm end (16, 17), connected connecting heads of a nodal member being interconnected with a single separate pin (28).

41. The article of seating furniture according to claim 40, wherein said pin engages in a substantially blind aperture of the connecting member.

* * * * *

UNITED STATES PATENT AND TRADEMARK OFFICE

CERTIFICATE OF CORRECTION

PATENT NO. : 4,852,944

DATED : August 1, 1989

INVENTOR(S) : Hartmann

It is certified that error appears in the above-identified patent and that said Letters Patent is hereby corrected as shown below:

Column 1, line 51, "of" should be --or--.

Column 2, line 38, delete "connection" and insert --connecting--.

Column 3, line 57, "of" should be --or--.

Column 5, line 57, after "connected", insert --connecting--.

Column 7, line 41, delete "timber".

Column 8, line 13, delete "suchg" and insert --such--.

Claim 10, column 9, line 58, after "seating" insert --furniture--.

Signed and Sealed this

Twenty-third Day of July, 1991

*Attest:*

HARRY F. MANBECK, JR.

*Attesting Officer*

*Commissioner of Patents and Trademarks*